US009590316B2

(12) United States Patent
Cartaillac et al.

(10) Patent No.: US 9,590,316 B2
(45) Date of Patent: Mar. 7, 2017

(54) ARRAY OF TWO TWIN-REFLECTOR ANTENNAS MOUNTED ON A COMMON SUPPORT AND A SATELLITE COMPRISING THIS ARRAY

(71) Applicant: THALES, Courbevoie (FR)

(72) Inventors: Erwan Cartaillac, Labatut (FR); Stephane Pouyez, L'Isle-Jourdain (FR); Daniel Medici, Toulouse (FR); Stephane Boffelli, Cannes-la-Bocca (FR); Alain Gerard, Toulouse (FR)

(73) Assignee: THALES, Courbevoie (FR)

( * ) Notice: Subject to any disclaimer, the term of this patent is extended or adjusted under 35 U.S.C. 154(b) by 63 days.

(21) Appl. No.: 14/694,686

(22) Filed: Apr. 23, 2015

(65) Prior Publication Data

US 2015/0311597 A1 Oct. 29, 2015

(30) Foreign Application Priority Data

Apr. 25, 2014 (FR) ..... 14 00978

(51) Int. Cl.

| | |
|---|---|
| ***H01Q 19/18*** | (2006.01) |
| ***H01Q 1/28*** | (2006.01) |
| ***H01Q 19/19*** | (2006.01) |
| ***H01Q 21/00*** | (2006.01) |

(52) U.S. Cl.

CPC ..... *H01Q 19/18* (2013.01); *H01Q 1/288* (2013.01); *H01Q 19/19* (2013.01); *H01Q 21/00* (2013.01)

(58) Field of Classification Search

None

See application file for complete search history.

(56) References Cited

U.S. PATENT DOCUMENTS

| | | | | |
|---|---|---|---|---|
| 6,211,835 | B1 | 4/2001 | Peebles et al. | |
| 6,307,521 | B1 | 10/2001 | Schindler et al. | |
| 6,366,255 | B1 * | 4/2002 | Chiang | H01Q 1/08 343/781 P |
| 6,366,256 | B1 * | 4/2002 | Ramanujam | H01Q 1/288 343/755 |
| 6,411,262 | B1 * | 6/2002 | Luh | H01Q 1/288 343/781 CA |
| 6,424,314 | B1 * | 7/2002 | Baghdasarian | H01Q 1/08 343/766 |

FOREIGN PATENT DOCUMENTS

| | | |
|---|---|---|
| EP | 0984512 A1 | 3/2000 |
| EP | 1020952 A1 | 7/2000 |

* cited by examiner

*Primary Examiner* — Trinh Dinh

(74) *Attorney, Agent, or Firm* — Baker & Hostetler LLP

(57) ABSTRACT

The two twin-reflector antennas comprise a common support on which they are mounted, with each twin-reflector antenna comprising a main reflector, a secondary reflector and at least one radiating source placed in front of the corresponding secondary reflector, and optical paths of beams produced by the two twin-reflector antennas crisscrossing one another.

10 Claims, 3 Drawing Sheets

ARRAY OF TWO TWIN-REFLECTOR ANTENNAS MOUNTED ON A COMMON SUPPORT AND A SATELLITE COMPRISING THIS ARRAY

CROSS-REFERENCE TO RELATED APPLICATION

This application claims priority to foreign French patent application No. FR 1400978, filed on Apr. 25, 2014, the disclosure of which is incorporated by reference in its entirety.

FIELD OF THE INVENTION

The present invention relates to an array of two twin-reflector antennas mounted on a common support and a satellite comprising this array. It applies to the domain of space applications and, in particular, to twin-reflector antennas with a long focal length which are intended to be installed on the same side of a satellite.

BACKGROUND

A twin-reflector antenna is comprised of a main reflector 10, a secondary reflector 11 and a radiating source 12 placed in front of the secondary reflector. The radiating source can operate in circular or linear monopolarization or bipolarization, in frequency monoband or frequency multiband mode. The radiating source 12 emits electromagnetic waves illuminating the secondary reflector 11 which reflects the electromagnetic waves towards the main reflector 10. The electromagnetic waves are then reflected by the main reflector 10 towards Earth, in the form of one or more beams, of which the footprints on the ground form a single-spot or multi-spot coverage respectively, according to the number of emitted beams.

When the twin-reflector antenna comprises a short focal length F, i.e. when the F/D ratio between the focal length F of the main reflector and the diameter D of the main reflector is between 0.8 and 1.1, it is possible to install two twin-reflector antennas 15, 25 on the same lateral side 30 of a satellite, by disposing the two twin-reflector antennas on either side of the median line 13 dividing the lateral side into two areas, as shown, for example, in FIG. 1. However, this type of antenna comprises reduced radio-frequency performance.

When the twin-reflector antenna comprises a long focal length, i.e. when the F/D ratio is greater than 1.1, the installation on the same side of a satellite is currently possible only by using deployable secondary reflectors installed on the Earth side of the satellite, the Earth side being the side of the satellite oriented towards the Earth. This poses problems of arrangement, since the Earth side of the satellite is generally intended for the installation of antennas and equipment linked to the overall purpose of the satellite. Furthermore, these antennas are complex and require the installation of a deployment system for the secondary reflectors, which increases the cost.

To the best of our knowledge, no solution currently exists for arranging two twin-reflector antennas, at least one of the two antennas having an F/D ratio greater than 1.1, on the same side of a satellite due to the size of the secondary reflectors. The problem is that this limits the number of antennas that can be installed on a satellite and therefore limits the number of tasks that can be performed.

SUMMARY OF THE INVENTION

The object of the invention is to overcome the disadvantages of known twin-reflector antennas and implement an array of two twin-reflector antennas which can be disposed on the same side of a satellite and which enable the focal length of the two antennas to be increased, and to guarantee a performance level higher than that obtained with known twin-reflector antenna arrays.

For this purpose, the invention relates to an array of two twin-reflector antennas, the two antennas comprising a common support on which they are mounted, each antenna comprising a main reflector, a secondary reflector and at least one radiating source placed in front of the corresponding secondary reflector, each antenna being capable of producing a beam, the two antennas criss-crossing one another on the common support.

Advantageously, the two radiating sources and the two secondary reflectors of the two antennas are respectively criss-crossed on the common support in relation to the two main reflectors of the two antennas.

The two twin-reflector antennas may advantageously have a common secondary reflector and radiating sources which criss-cross one another on the common support.

Alternatively, the two antennas may have a common main reflector, the two radiating sources and the two secondary reflectors of the two antennas then respectively criss-crossing one another on the common support.

The main reflector of at least one of the two antennas advantageously has an F/D ratio greater than 1.1, where F and D are the focal length and diameter respectively of said main reflector.

The main reflectors of the two antennas may advantageously be fixed onto the common support or may be deployable.

The invention also relates to a satellite which comprises at least one array of two twin-reflector antennas, the common support of the two antennas being a side of the satellite which may, in particular, be a lateral side of the satellite or an Earth side.

BRIEF DESCRIPTION OF THE DRAWINGS

Other characteristics and advantages of the invention will be clearly explained in the description which follows, given as a purely illustrative and non-limiting example, with reference to the attached schematic drawings, in which.

DETAILED DESCRIPTION

Figure 1:
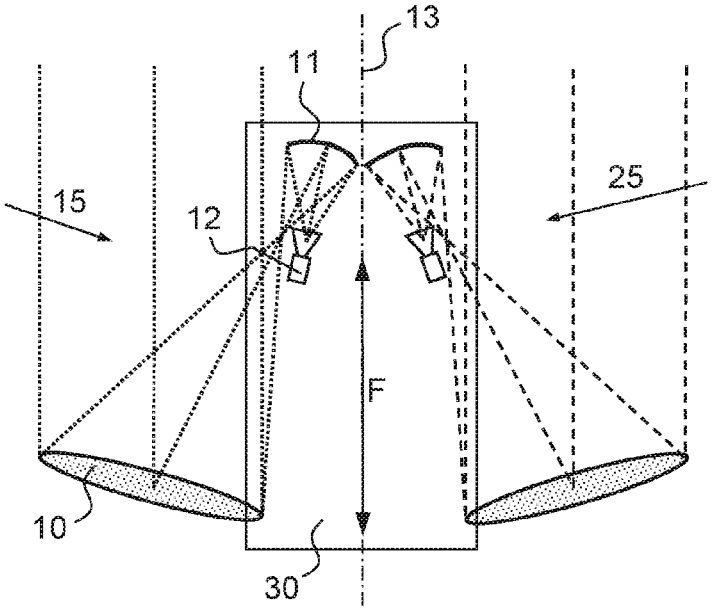
FIG.1 (PRIOR ART)
FIG. 1 shows a cutaway diagram of an example of an array of two twin-reflector antennas, according to the prior art.
Figure 2:
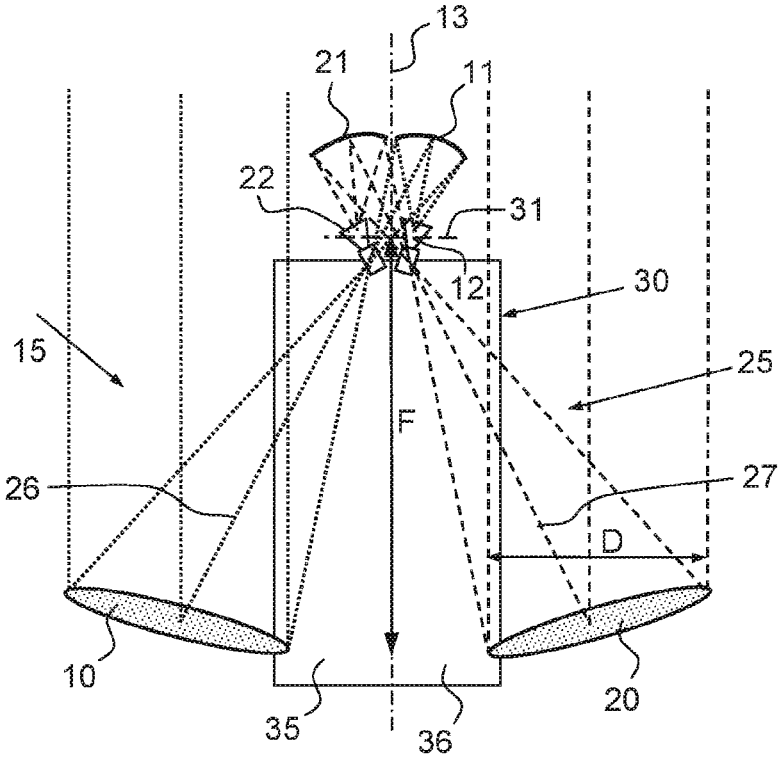
FIG. 2 shows a cutaway diagram showing a first example of an array of two twin-reflector antennas in double deployment, according to the invention.

FIG. 2 shows an array of two twin-reflector antennas 15, 25, the two antennas being mounted on a common support 30, for example the same side of a satellite, the side of the satellite being able to be, for example, a lateral side or an Earth side of the satellite. Each antenna comprises a main reflector 10, 20, a secondary reflector 11, 21, and at least one radiating source 12, 22 illuminating the corresponding secondary reflector. The two antennas may have the same dimensions and the same focal length F, but this is not obligatory. Instead of being disposed on either side of a median line 13 of the common support 30, the two twin-reflector antennas 15, 25 criss-cross one another on the common support, thus enabling the main reflectors to be brought close to one another on the common support. As shown in FIG. 2, the optical paths 26, 27 of the beams produced by the two antennas criss-cross one another, the crossover point of the optical paths being located between the main reflector and the secondary reflector of each antenna. Thus, in FIG. 2, the common support comprises two different areas 35, 36 delimited by a median line 13, the two areas 35, 36 being located, in the example shown in FIG. 2, to the left and right respectively of the median line 13. The radiating source 12 and the secondary reflector 11 of the first twin-reflector antenna 15 are disposed in the second area 36, to the right of the median line, whereas the main reflector 10 of said first twin-reflector antenna is disposed in the first area 35, to the left of the median line. The configuration of the second twin-reflector antenna 25 is symmetrical to the first twin-reflector antenna 15 in relation to the median line 13. Consequently, for each twin-reflector antenna, the radiating source and the secondary reflector are disposed in the same first area in relation to the median line of the common support, whereas the main reflector of the corresponding antenna is located in a second area opposite the first area in relation to the median line of the common support. Thus, the radiating sources 12, 22 of the two antennas criss-cross one another, and the two secondary reflectors 11, 21 of the two antennas also criss-cross one another. This offers the advantage of being able to bring the two main reflectors 10, 20 of the two antennas 15, 25 close to one another and enabling the focal length of the two twin-reflector antennas to be increased. At least one of the two antennas can then have an F/D ratio greater than 1.1, where F and D are the focal length and diameter respectively of the main reflector of the antenna, the diameter of the main reflector corresponding to the radiating aperture of the main reflector projected onto the Earth.

The main reflectors 10, 20 of the two twin-reflector antennas may be mounted in a fixed fashion on the common support 30 or may be mounted via a deployment system in such a way as to be deployable.

Figure 5:
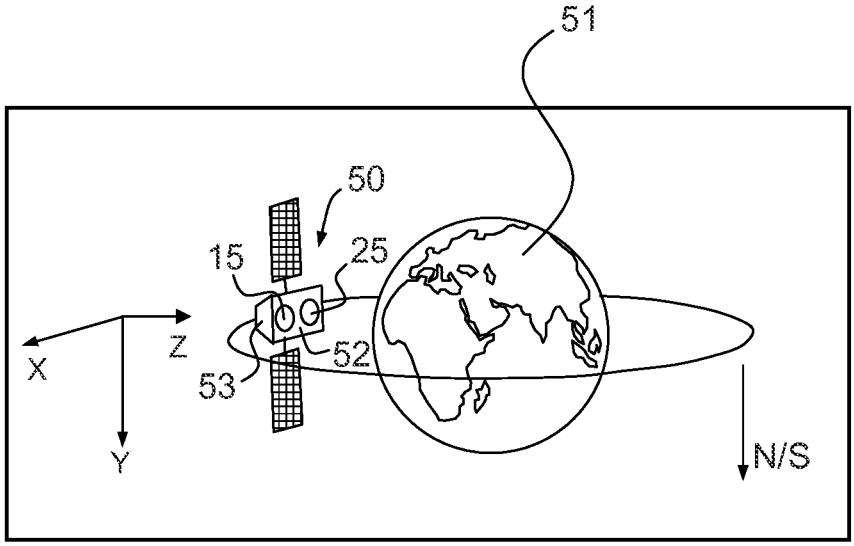
FIG. 5 shows a diagram of an example of a satellite including an array of two antennas on the same side, according to the invention.

The common support 30 may be fixed on any side of a satellite and may, in particular, be fixed on a lateral side 53 or on the Earth side 52 of the satellite, i.e. the side oriented towards the Earth. In the example shown in FIG. 5, the satellite 50 is in orbit around the Earth 51 and comprises an array of antennas mounted on the Earth side 52.

Figure 3:
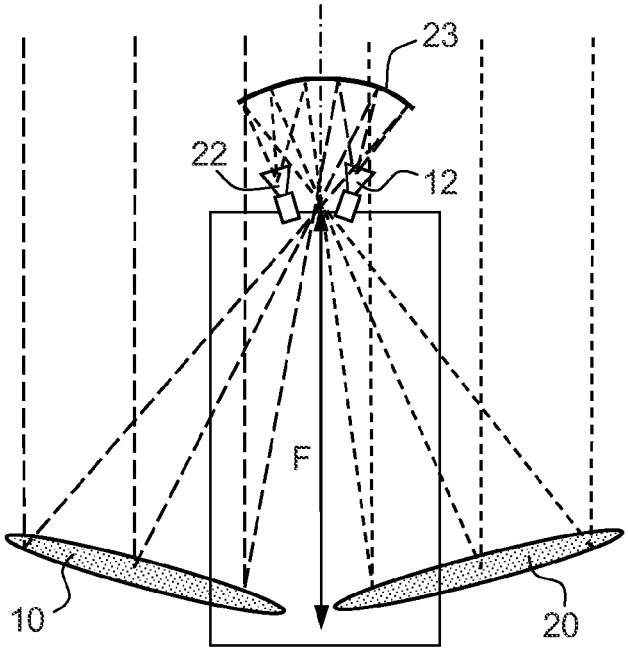
FIG. 3 shows a cutaway diagram showing a second example of an array of two twin-reflector antennas in single deployment, according to the invention.

The two twin-reflector antennas 15, 25 may have two different secondary reflectors 11, 21, separated from one another as shown in FIG. 2. Alternatively, the two twin-reflector antennas may have a common secondary reflector 23, as shown in FIG. 3, and radiating sources which criss-cross one another in the focal plane of the common secondary reflector.

Figure 4:
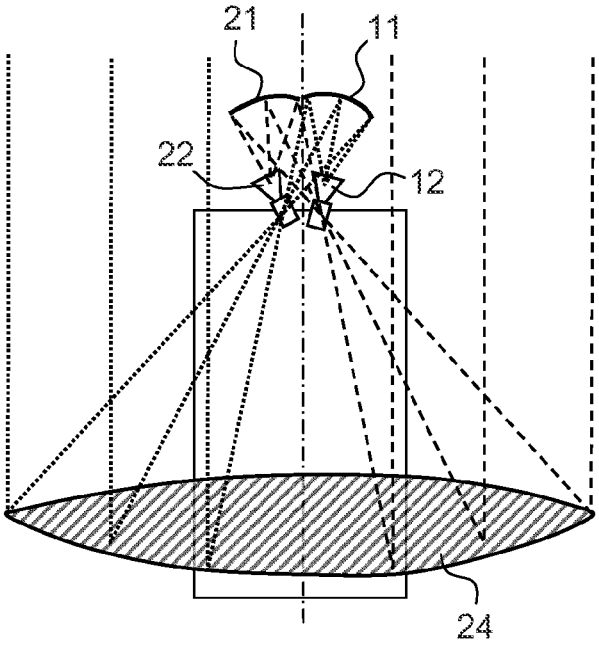
FIG. 4 shows a cutaway diagram showing a third example of an array of two twin-reflector antennas, the main reflector being common to the two antennas, according to the invention.

Similarly, the two twin-reflector antennas 15, 25 may have two different main reflectors 10, 20 separated from one another as shown in FIG. 2. Alternatively, the two twin-reflector antennas may have a common main reflector 24, as shown in FIG. 4, the two radiating sources 12, 22 and the two secondary reflectors 11, 21 of the two antennas 15, 25 respectively criss-crossing one another on the common support 30.

Although the invention has been described in connection with particular embodiments, it is obvious that it is in no way limited thereto and that it includes all the technical equivalents of the means described and also their combinations if they fall within the scope of the invention.

The invention claimed is:

1. An array of two twin-reflector antennas, the two antennas comprising a common support on which the two antennas are mounted, each antenna comprising a main reflector, a secondary reflector and at least one radiating source placed in front of the corresponding secondary reflector, each antenna being capable of producing a beam, wherein optical paths of beams produced by the two antennas criss-cross one another.

2. The array of two twin-reflector antennas according to claim 1, wherein the two radiating sources and the two secondary reflectors of the two antennas respectively criss-cross one another on the common support in relation to the main reflectors of the two antennas.

3. The array of two twin-reflector antennas according to claim 1, wherein the two antennas have a common secondary reflector and have radiating sources which criss-cross one another on the common support.

4. The array of two twin-reflector antennas according to claim 1, wherein the two antennas have a common main reflector and wherein the two radiating sources and the two secondary reflectors of the two antennas respectively criss-cross one another on the common support.

5. The array of two twin-reflector antennas according to claim 1, wherein the main reflector of a least one of the two antennas has an F/D ratio greater than 1.1, where F and D are the focal length and diameter respectively of said main reflector.

6. The array of two twin-reflector antennas according to claim 1, wherein the main reflectors of the two antennas are fixed onto the common support.

7. The array of two twin-reflector antennas according to claim 1, wherein the main reflectors of the two antennas are deployable.

8. A satellite, comprising at least one array of two twin-reflector antennas according to claim 1, the common support of the two antennas being a side of the satellite.

9. The satellite according to claim 8, wherein the side of the satellite is a lateral side.

10. The satellite according to claim 8, wherein the side of the satellite is an Earth side.

* * * * *